US008684212B2

(12) United States Patent
Stone et al.

(10) Patent No.: US 8,684,212 B2
(45) Date of Patent: Apr. 1, 2014

(54) TAMPER-EVIDENT CONTAINER THAT INDICATES WHEN THE CONTAINER HAS BEEN TAMPERED WITH OR OPENED

(76) Inventors: Joseph Stone, Cadiz, KY (US); Gregory Jimenez, Hoffman Estates, IL (US); Richard M. Collins, Cary, IL (US)

( * ) Notice: Subject to any disclaimer, the term of this patent is extended or adjusted under 35 U.S.C. 154(b) by 0 days.

(21) Appl. No.: 13/545,179

(22) Filed: Jul. 10, 2012

(65) Prior Publication Data

US 2013/0020325 A1 Jan. 24, 2013

Related U.S. Application Data

(60) Provisional application No. 61/508,933, filed on Jul. 18, 2011.

(51) Int. Cl.
*B65D 17/34* (2006.01)

(52) U.S. Cl.
USPC ..... 220/270; 220/269; 220/268; 220/266; 220/265; 220/780

(58) Field of Classification Search
USPC ..... 220/214, 265–266, 270, 789, 791, 793, 220/801–802, 805; 206/459.1, 499
See application file for complete search history.

(56) References Cited

U.S. PATENT DOCUMENTS

| | | | | |
|---|---|---|---|---|
| 3,580,473 | A | 5/1971 | Gill | |
| 6,032,827 | A * | 3/2000 | Zettle et al. | 220/788 |
| D448,991 | S * | 10/2001 | Zettle et al. | D9/425 |
| 6,971,539 | B1 | 12/2005 | Abbe | |
| 7,913,870 | B2 | 3/2011 | Vovan | |
| 2007/0045317 | A1 * | 3/2007 | Rosender et al. | 220/266 |
| 2007/0138180 | A1 * | 6/2007 | Vovan | 220/266 |
| 2009/0120937 | A1 * | 5/2009 | Vovan | 220/266 |
| 2009/0206082 | A1 * | 8/2009 | Vovan | 220/266 |
| 2010/0051620 | A1 * | 3/2010 | Parikh et al. | 220/270 |
| 2010/0084401 | A1 * | 4/2010 | Golota et al. | 220/270 |
| 2010/0276422 | A1 * | 11/2010 | Vovan et al. | 220/260 |
| 2011/0031246 | A1 | 2/2011 | Massey, Jr. | |
| 2012/0005994 | A1 * | 1/2012 | Tidball et al. | 53/484 |
| 2012/0292322 | A1 * | 11/2012 | Meyer et al. | 220/270 |

OTHER PUBLICATIONS

International Search Report, Int'l Application No. PCT/US2012/046184, dated Sep. 14, 2012; 2 pages.
Written Opinion of the International Search Authority, Int'l Application No. PCT/US2012/046184, dated Sep. 14, 2012; 19 pages.

* cited by examiner

*Primary Examiner* — Mickey Yu
*Assistant Examiner* — Brijesh V. Patel
(74) *Attorney, Agent, or Firm* — Seyfarth Shaw LLP

(57) ABSTRACT

A tamper-evident container having a tamper-evident structure that indicates to a user when the container has been previously opened or otherwise tampered with. The container can include a body and a lid, where the lid is snap fit into a recess of the body. Based on the snap-fit, the lid is difficult or impossible to remove from the body without activating the tamper-evident structure. The tamper-evident structure can remain at least partially attached to the lid or body to thereby indicate to a user that the container has been opened or otherwise tampered with.

11 Claims, 10 Drawing Sheets

TAMPER-EVIDENT CONTAINER THAT INDICATES WHEN THE CONTAINER HAS BEEN TAMPERED WITH OR OPENED

RELATED APPLICATION

This application claims the priority of, and hereby incorporates by reference, provisional application Ser. No. 61/508,933 filed Jul. 18, 2011.

FIELD OF THE INVENTION

The present invention relates to tamper-evident containers. More particularly, the present invention relates to a tamper-evident container having a corner adapted to be partially broken upon a user opening the container, thereby providing a visual indication of tampering.

BACKGROUND OF THE INVENTION

Plastic containers are a well-known form of housing objects, especially perishable foods that can spoil. Such containers come in different shapes and sizes, and can store consumable items such as fruits, vegetables, or other food items.

Containers for storing food items can have tamper-evident qualities such that the container visually depicts whether the container was previously opened, thus providing an indication that the contents were tampered with. In this manner, a buyer can be assured that the container has not been opened, and that the contents of the container have not been altered since the container was initially closed.

Conventional tamper-evident structures are insufficient for many reasons. For example, typical tamper-evident structures create an opening in the container that exposes the container contents, leading to possible spoiling of the contents. Also, some tamper-evident containers are flexible and allow a user to open the container without activating the tamper-evident structure. In addition, many tamper-evident structures include removable features that do not allow the container to be reused. Moreover, these tamper-evident structures do not clearly indicate that the container has been opened because the absence of the structure, rather than the presence of an altered tamper-evident structure, indicates to the user that the container has been opened. Therefore, if the user does not know that a tamper-evident structure should be present, and the tamper-evident structure is missing, the user may be unaware that the tamper-evident structure was activated.

SUMMARY OF THE INVENTION

The present application relates to tamper-evident containers having a tamper-evident structure that visually indicates that the container was previously opened, but further does not allow opening of the container without activation of the tamper-evident structure. The tamper-evident container can include a lid releasably coupled to a body defining a cavity, where the lid is snap-fit into the body. In an embodiment, the lid cannot be removed from the body without pulling a corner of the container and thereby activating the tamper-evident structure. The tamper-evident structure remains partially attached to the lid or body to thereby provide a visual indication that the container has been opened or otherwise tampered with.

For example, the present application discloses a container with a tamper-evident structure indicating that the container has been opened, including a body having a body corner, and a lid adapted to be removably coupled to the body and having a lid corner, the lid being coupled to the body unless a force is exerted around one of the body corner and the lid corner, wherein the body corner and the lid corner are adapted to matingly engage with each other, and at least one of the body corner and the lid corner is coupled to the body or the lid, respectively, by at least a partial perforated edge.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

FIG. 1*a* is a perspective side view of an embodiment of a container incorporating the present invention where the tamper-evident structure does not indicate that the container has been tampered with.

FIG. 1*b* is a perspective side view of an embodiment of a container incorporating the present invention where the tamper-evident structure indicates that the container has been opened or otherwise tampered with.

DETAILED DESCRIPTION OF PREFERRED EMBODIMENTS

Figure 1A:
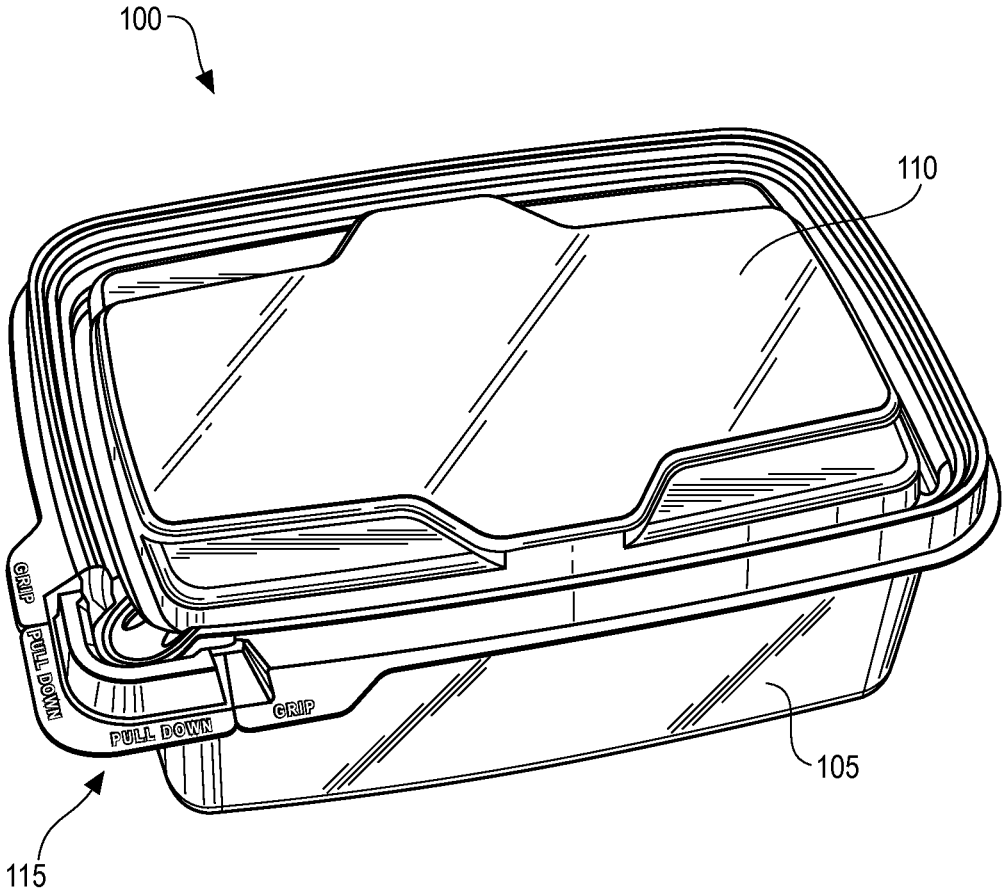

While the present invention is susceptible of embodiments in many different forms, there is shown in the drawings and will herein be described a preferred embodiment of the invention with the understanding that the present disclosure is to be considered as an exemplification of the principles of the invention and is not intended to limit the broad aspect of the invention to embodiments illustrated.

Moreover, while the present invention is described as being a container food or other perishable items, it will be appreciates that the container and tamper-evident structure of the present invention can be used to store any type of item without departing from the spirit and scope of the present application.

The present invention relates to a container having a tamper-evident structure adapted to indicate whether the container was previously opened or otherwise tampered with. The container can include a lid releasably coupled to a body, wherein the lid is snap-it into a recess of the body. Based on the structure of the body and lid, the lid cannot be removed from the body without activating the tamper-evident structure. In an embodiment, the tamper-evident structure can remain partially attached to the lid or body to indicate whether the container was opened or otherwise tampered with.

Figure 1B:
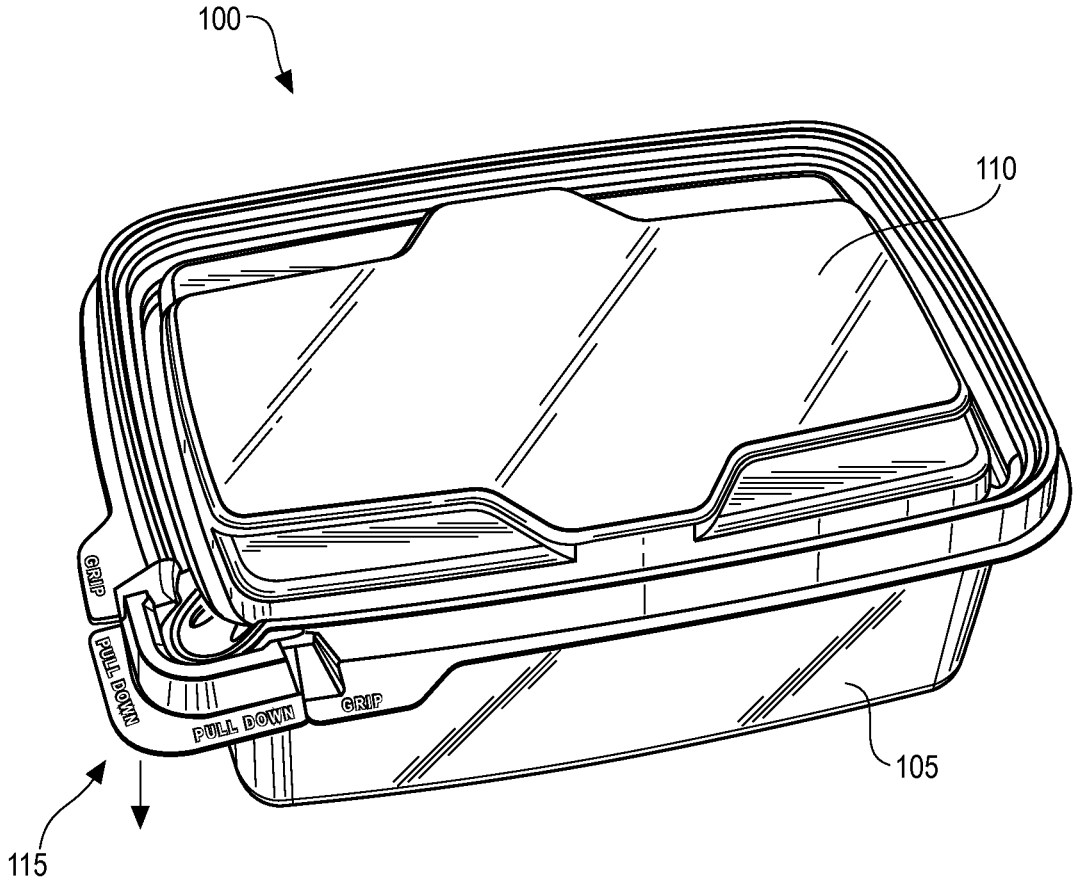

Referring to FIG. 1*a*, a container 100 is shown having a body 105 and a lid 110 adapted to be releasably coupled to the body 105. A tamper-evident structure 115 is provided on a corner of the body 105 and lid 110, which allows the lid 110 to be removed from the body 105 subsequent to activation of the tamper-evident structure 115. As an exemplary illustration, the container 100 shown in FIG. 1*a* has not been opened or otherwise tampered with wherein the lid 110 is releasably coupled to the body 105, and thus the tamper-evident structure 115 is fully attached to the body 105 and has not been activated. The container 100 of FIG. 1*b* shows the tamper-evident structure of the present invention activated to indicate that the container 100 has been opened or otherwise tampered with.

Figure 2:
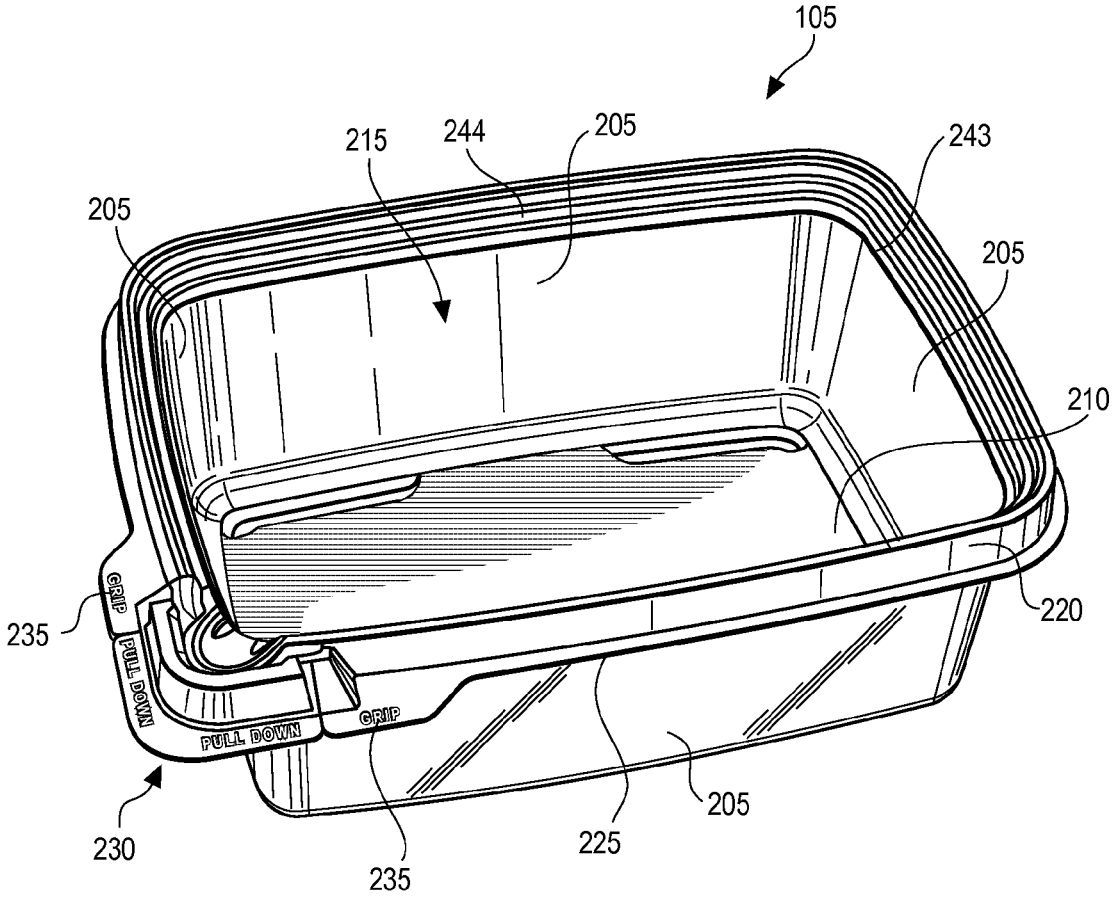
FIG. 2 is a top perspective view of the container of FIG. 1*a* or 1*b* with the container lid removed.

FIG. 2 shows a body 105 of the container 100 with the lid 110 decoupled from the body 105. In an embodiment, the body 105 includes four upstanding walls 205, e.g. one at its front, rear, left and right sides, and a bottom 210, thereby defining a cavity 215 where contents can be placed. It will be appreciated that while the present application discusses the container 100 in the shape of a rectangle, any shape container can be used, such as, for example, square or circular, without departing from the scope and sprint of the present application. Moreover, the bottom 210 is shown as being substantially perpendicular to the walls 205 at rounded transitions thereof. However, the bottom 210 can engage the wall 205 at an angle, can be rounded relative to the walls 205, or can engage the wall 205 at sharp corners, rather than the rounded corner shown in FIGS. 2 and 3.

In an embodiment, a peripheral lip 220 can be provided on the peripheral edge of the body 105 and is adapted to cooperate with the lid 110 to releasably couple the lid 110 to the body 105. In an embodiment, a ledge 225 extends outwardly from the lip 220 to provide additional structural stability. The lip 220 is adapted to matingly engage the lid 110, such as in a snap-lock fashion, to substantially enclose the cavity 215. In an embodiment, the lid 110 is not placed over the lip 220, but the lid 110 is placed inside the cavity 215 and engages with an engagement lip 243 that extends inwardly relative to the walls 205 and extends around the periphery of the body 105. The lid 110 can thus releasably engage the body 105 by elastically deforming and being pushed across the engagement lip 243, as discussed below, thereby sealing the contents in the container 100.

A body corner 230 can be provided to matingly engage with a corner of the lid 110 to thereby define a tamper-evident structure 115, as described below. The body corner 230 can be attached to one or more grips 235 by way of perforated or scored edge 250 that is adapted to be broken upon partial or full decoupling of the lid 110 from the body 105. The body corner can extend from a first peripheral edge to a second peripheral edge, and can have a body corner perimeter extending around a perimeter of the body corner 230.

The lid 110 can snap-fit into the body 105 and is recessed within the body 105 when coupled thereto. In this fashion, the lid 110 can be difficult, if not impossible, to remove from the body 105 without first lifting upward on some portion of the lid 110. Accordingly, a user is forced to first break the tamper-evident structure 115 along edge 250 in order to access the corner of the lid 110 to partially or fully decouple the lid 110 from the body 105 for the first time. Such breakage indicates that the container 100 has previously been opened or otherwise tampered with.

This is beneficial, for example, when a user wants to ensure that the container 100 has not been tampered with. Moreover, as another benefit of the present invention, even after activation of the tamper-evident structure 115, the lid 110 can still be releasably coupled to the body 105 for continued use. So, for example, if a user purchases strawberries in the container 100, the user can ensure that the strawberries were not tampered with via the tamper-evident structure 115. Upon first opening the container 100 by removing the lid 110 from the body 105, the user must activate the tamper-evident structure 115 to access the corner of the lid 110. After activation, the user can still continue to releasably couple the lid 110 to the body 105 for continued use.

Figure 3:
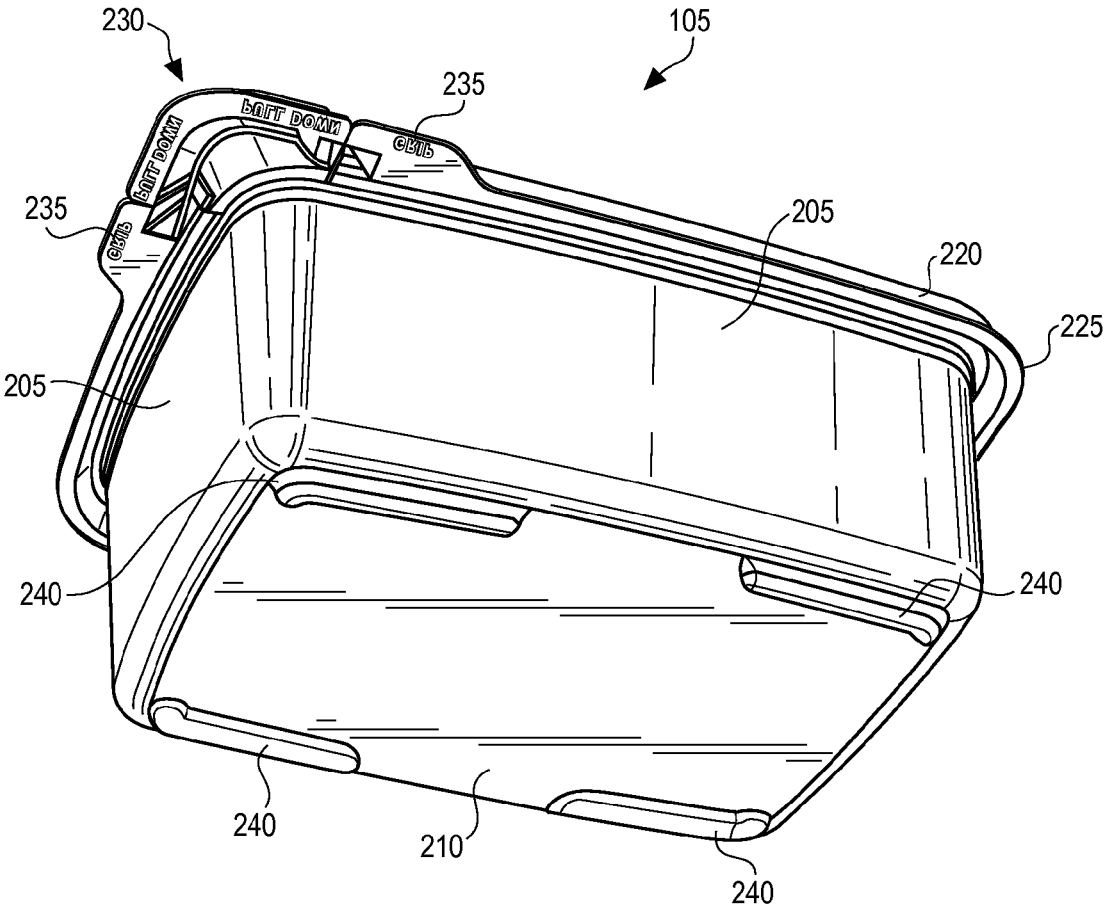
FIG. 3 is a bottom perspective view of the container of FIG. 1*a* or 1*b*.

As shown in FIGS. 2 and 3, the walls 205 are four in number so that the container 100 forms a rectangular cavity. However, the number of walls 205 is not limited, and the body 105 may include three walls 205 to provide a triangular shape, or may include six walls 205 to provide a hexagonal shape. The body 105 could also be circular, oval, or otherwise round. Additional walls can also be included internal to the cavity to provide compartments therein. Any other number of walls 205 or shape of body 105 can be used without departing from the spirit and scope of the present application.

The bottom 210 is shown as being substantially perpendicular to the walls 205 at rounded transitions thereof. However, the bottom 210 can engage the wall 205 at an angle, can be rounded relative to the walls 205, or can engage the wall 205 at sharp corners, rather than the rounded corner shown in FIGS. 2 and 3.

The lip 220 is adapted to matingly engage the lid 110, such as in a snap-lock fashion, to substantially enclose the cavity 215. In an embodiment, the lid 110 is not placed over the lip 220, but the lid 110 is placed inside the cavity 215 and engages with an engagement lip 243 that extends inwardly relative to the walls 205 and extends around the periphery of the body 105. The lid 110 can thus releasably engage the body 105 by elastically deforming and being pushed across the engagement lip 243, as discussed below, thereby sealing the contents in the container 100.

In an embodiment, the container 100 includes vents 244 on the lid 110 and/or body 105 to allow air into and out of the container 100. The vents 244 are advantageous for foods that emit gasses after being stored in a container or otherwise require a "breathable" container. Gas can also be trapped in the container 100 when closing the lid 110 to the body 105. The vents 244 allow such gas to escape without creating excessive internal pressure in the container 100. As one of ordinary skill would appreciate, the number, size and shape of vents 244 can vary within the spirit and scope of the invention.

In an embodiment, the ledge 225 is an outwardly extending portion of the lip 220, where the user can insert underneath the lip 220 to better grip the lid 110. As shown, the ledge 225 extends circumferentially around the lip 220, except for portions adjacent the body corner 230. However, the length and distribution of the ledge 225 can be more or less than that shown in the figures, or can be non-uniformly distributed around the lip 220, without departing from the spirit and scope of the present application.

As shown in FIG. 3, the outside of the bottom 210 can include protrusions 240, such as feet, outwardly extending from the bottom 210 of the container 100 to provide an elevated surface of the bottom 210 relative to a ground plane. The protrusions 240 help raise the container 100 above the ground plane by providing objects on the bottom 210 of the body 105. However, any variation of the protrusions 240 can be used to raise the container 100 from the ground plane. For example, the protrusions 240 can be a continuous rail that extends adjacent an outer periphery of the container 100 rather than having discontinuous protrusions 240, as shown in FIG. 3. Further, a center protrusion can be provided to raise the container 100 from the ground plane, either independently from or in combination with the feet 240. The center protrusion can also be applied in combination with a rail that extends around the periphery of the bottom 210 of the container 100. It will be appreciated that the protrusions 240 allow stacking of a plurality of containers 100. Moreover, it will be appreciated that protrusions 240 can be omitted.

Figure 4:
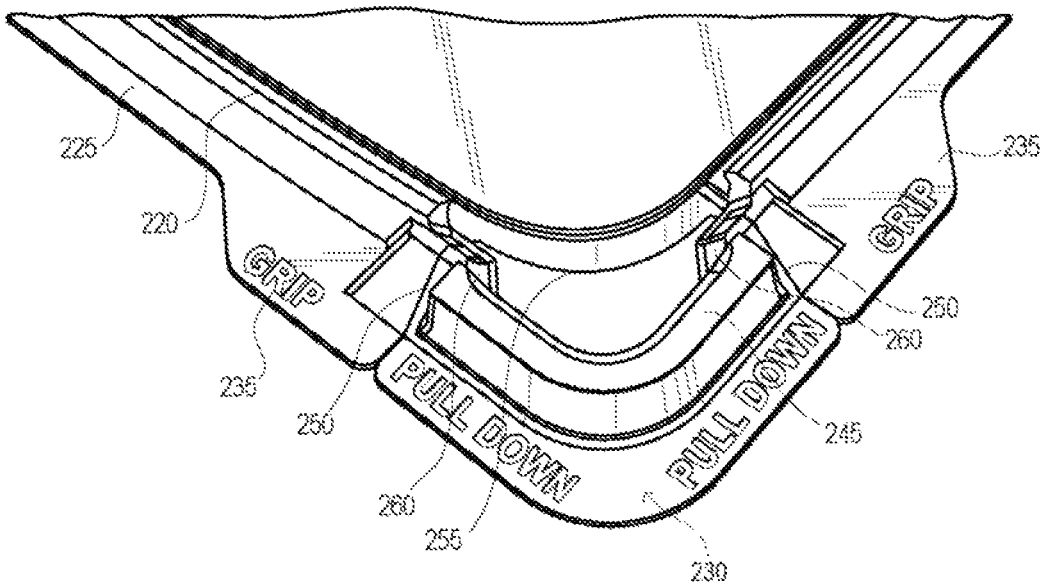
FIG. 4 is an enlarged perspective view of the tamper-evident structure of the container of FIG. 1*a* or 1*b*.

FIG. 4 illustrates a body corner 230 including an embodiment of the tamper-evident structure 115 of the present invention. As shown, the body corner 230 includes a deformable tab 245 that is adapted to be gripped with fingers to pull the tamper-evident structure 115 downwardly and activate it by breaking the tamper-evident structure 115 along perforated edges 250, allowing a user to access the corner of the lid 110 to remove, either partially or completely, the lid 110 from the body 105 to access the contents in the container 100. As discussed above, once coupled to the body 105, the lid 110 is difficult or impossible to remove without first activating the tamper-evident structure 115.

As shown, the tab 245 may be substantially L-shaped, with a rounded corner connecting two straight portions. However, the tab 245 can be circular, rectangular, or can be any other shape that allows a user to grip the tamper-evident structure 115 and activate it.

In an embodiment, the body corner 230 is coupled to the grip 235 by way of partially perforated edges 250. The perforated edges 250 allow the user to decouple the body corner 230 from the remainder of the body 105 with relative ease to allow access to a corner of the lid 110, while still connecting the grip 235 to the corner 230 after activation of the tamper-evident structure 115. As shown, the perforated edges 250 connect the body corner 230 to two grips 235, and can also connect the body corner 230 to the body 105 adjacent the hinge 255. The location of the perforated edges 250 can be helpful in achieving the goal of disallowing user entry into the container 100 without activating the tamper-evident structure 115. For example, the perforated edges 250 can include two discrete connections between the body corner 230 and the grips 235, the connections being at the most outward peripheral points of the container 100, i.e., between the "GRIP" and "PULL DOWN" labels in FIGS. 2 and 4. In this manner, the perforated edges 250 must be broken to pull downwardly on the body corner 230 to release the lid 110 from the body 105.

The hinge 255 is a portion that couples the body corner 230 to the body 105. The hinge 255 can include an elastomeric or deformable interface and may include perforated edges surrounding the interface that couple the body corner 230 to the remainder of the body 105. Alternately, the hinge 255 includes one or more smooth, discontinuous edges adjacent the hinge 255. As shown, the hinge 255 allows the tamper-evident structure 115 to be activated, but the body corner 230 still remains coupled to the body 105 at the hinge 255. Thus, a user can see that the tamper-evident structure 115 is activated, because although the contents of the container 100 can be obtained after the tamper-evident structure 115 is activated, the body corner 230 remains partially coupled to the body 105 by way of the hinge 255, to alert the user that the tamper-evident structure 115 has been activated.

The body corner 230 may include a ramp 260 aligned in the direction of the user-applied diagonal and downward force to activate the tamper-evident structure 115. In other words, the ramp 260 is angled in substantially the same direction that a user is likely to apply a force to activate the tamper-evident structure 115.

Figure 5:
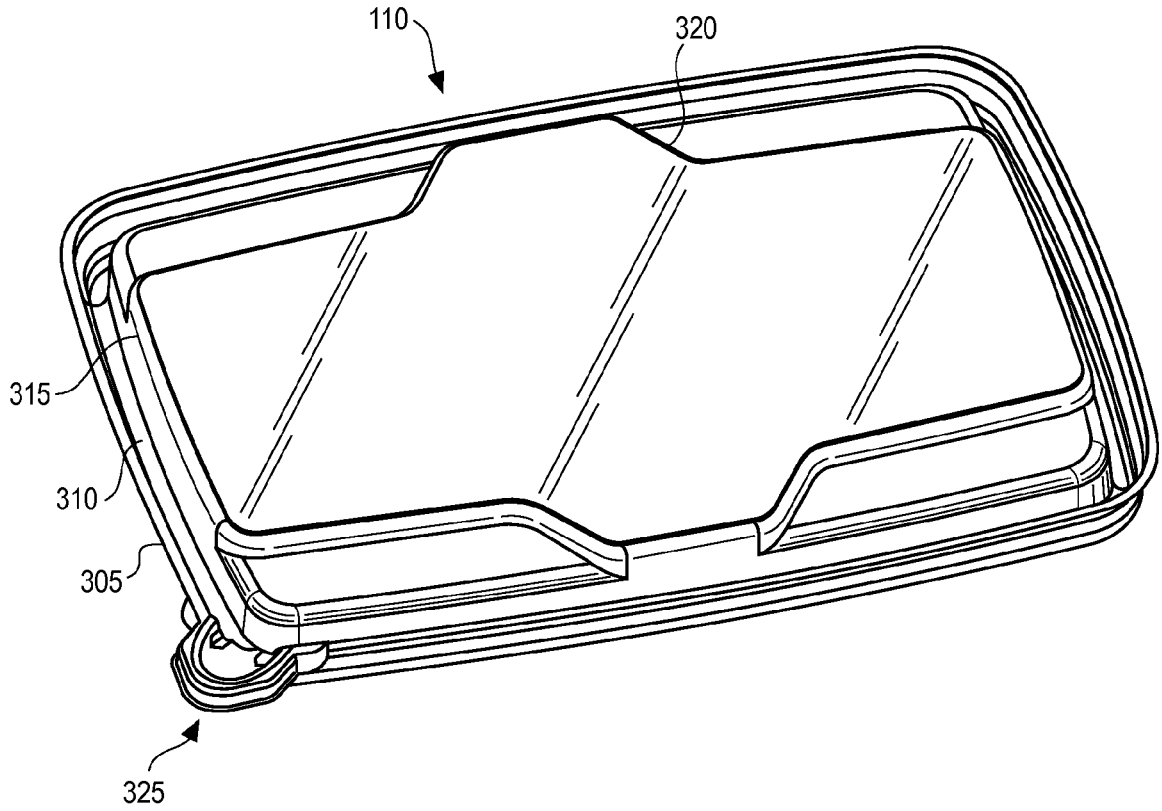
FIG. 5 is a top perspective view of the lid of the container of FIG. 1*a* or 1*b*.

The lid 110 of the present invention will be discussed with reference to FIGS. 5 and 6. As shown, the lid 110 includes a peripheral flange 305 extending around the outer peripheral edge of the lid 110, and a trough 310 extending from the flange 305 and coupled to a stiffening ledge 315 provided at an inward peripheral portion of the lid 110. The lid 110 also includes raised portions 320 adapted to allow the user to grip the lid 110 when the lid 110 has been removed from the body 105. The lid 110 also includes a lid corner 325 that can rest in or engage the body corner 230 to collectively form the tamper-evident structure 115 with the body corner 230.

The trough 310 of the lid 110 extends downwardly and can engage the engagement lip 243 of the body 105 so that the lid 110 is removably coupled to the body 105. For example, the trough 310 can elastically deform by way of an open space inside the trough 310 so that the engagement lip 243 of the body 105 pinches the trough 310 when the lid 110 engages with the engagement lip 243. In an embodiment, the flange 305 prevents the lid 110 from being inserted too far into the body 105 by providing an extending surface that rests on top of the engagement lip 243 and resists movement of the lid 110 into the body 105. Alternately, or in addition to the above, the trough 310 can include a peripheral groove adapted to matingly engage the engagement lip 243 and better secure the lid 110 to the body 105.

The stiffening ledge 315 can be a rounded peripheral extending portion that provides additional stiffness to the lid 110 and suppresses flexing of the lid 110. The stiffening ledge 315 can extend around the periphery of the lid 110 slightly inwardly from the trough 310, and can form an inner boundary of the trough 310. The stiffening ledge 315 is rounded at its boundary with the trough 310, and in combination with the trough 310, makes removing the lid 110 difficult or nearly impossible without first activating the tamper-evident structure 115 and pulling on the lid corner 325. That is, the stiffening ledge 315 resists the inward force of fingers (or other gripping means) on the lid 110 to disallow flexing of the lid 110 and removal of the lid 110 from the body 105 without activating the tamper-evident structure 115.

Figure 6:
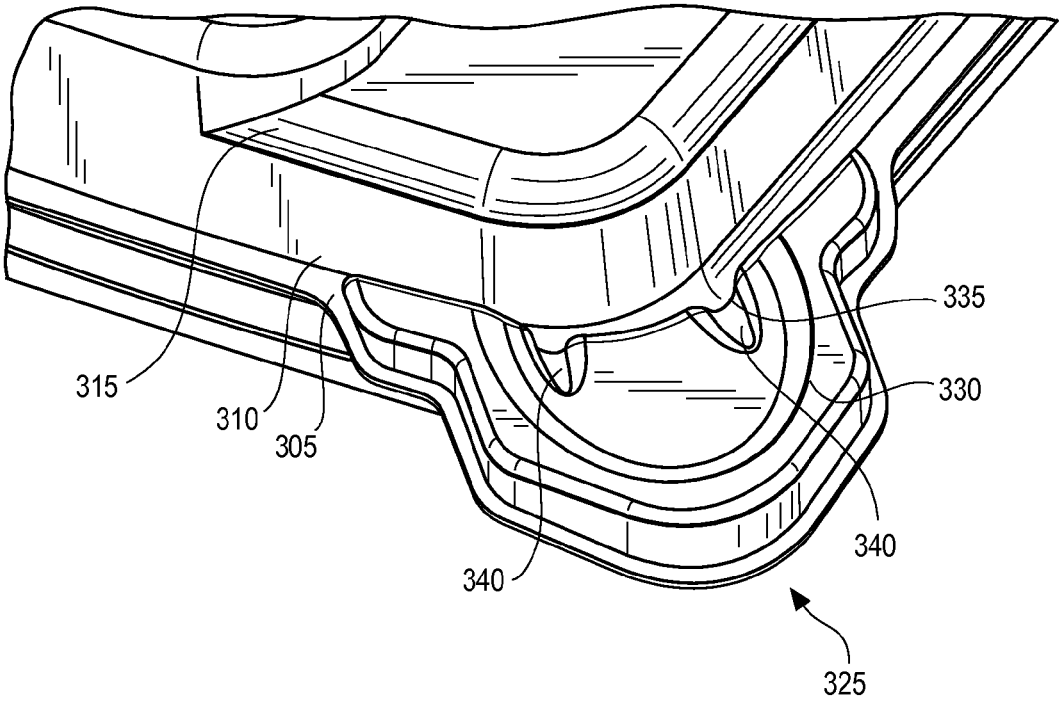
FIG. 6 is an enlarged perspective view of the tamper-evident structure of the lid of the container of FIG. 1*a* or 1*b*.

As shown in FIG. 6, the lid corner 325 includes a perimeter 330 that allows a user to grip the tamper-evident structure 115, similar to the tab 245 of the body corner 230. The lid corner 325 is coupled to the lid 110 by interface 335. Further, the lid corner 325 includes ribs 340 that provide additional structural support for the lid corner 325 and suppress bending of the lid corner 325.

Similar to the tab 245, the perimeter 330 can be any shape that allows a user to grip the lid corner 325 and activate the tamper-evident structure 115. As shown, the perimeter 330 is semicircular or semielliptical. However, the perimeter 330 can be partially or fully rectangular, triangular, circular, or any other shape that allows a user to grip the lid corner 325 and activate the tamper-evident structure 115. In an embodiment, the perimeter 330 is a shape similar to that of the tab 245 to allow better fitting between the lid corner 325 and the body corner 230. The perimeter 330 can be placed above the tab 245 and can be received within the tab 245 such that pulling downwardly on perimeter 330 also pulls downwardly on the tab 245.

The interface 335 can be a rigid structure that couples the lid corner 325 to the remainder of the lid 110. The interface 335 can be a rigid connection to require a force to pull down on the lid corner 325 and break the perforated edges 250 of the body corner 230. In a similar manner, the ribs 340 also strengthen the interface 335 between the lid corner 325 and the remainder of the lid 110 to require additional force to activate the tamper-evident structure 115. Based on this additional strength, a user is not likely to accidentally activate the tamper-evident structure 115, because a purposeful amount of force is required to activate the tamper-evident structure 115. The additional strength of the interface 335 is also helpful for when a user wishes to remove the lid 110 after activating the tamper-evident structure 115. When removing the lid 110, the user is required to pull upwardly on the lid corner 325 and disengage the trough 310 from the engagement lip 243. Thus, it is helpful for the lid corner 325 to have a substantial amount of strength for the purposes of durability, knowing that a user is likely to apply stress on the lid corner 325 upon each removal of the lid 110.

The shape of the lid corner 325 can be any shape that allows a user to lift the lid 110 and remove it from the body 105. In an embodiment, the lid corner 325 is coupled to or integral with the trough 310 and helps cover the cavity 215 of the body 105 to protect the contents therein. In this manner, even though the tamper-evident structure 115 is activated, the container 100 can be reused and the lid 110 can be releasably coupled to the body 105 and the contents of the container 100 can still be protected from outside elements.

Figure 7:
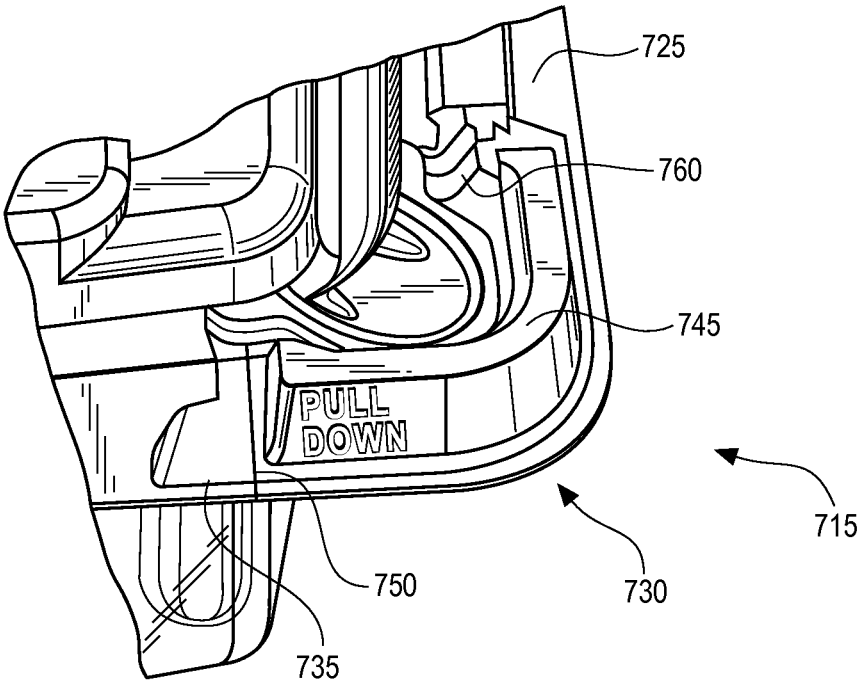
FIG. 7 is an enlarged perspective view of a tamper-evident structure according to an embodiment of the present application.

FIG. 7 illustrates a tamper-evident structure 715 according to another embodiment of the present application. As shown, the tamper-evident structure 715 can include a ledge 225, body corner 730, grip 735, tab 745, perforated edges 750, and ramp portion 760, similar to the tamper-evident structure shown in FIG. 4. The tamper-evident structure 715 of FIG. 7 differs from that shown in FIG. 4 by reducing the width of the ledge 725 located on the periphery of the container 100, or increasing the width of the ledge 725 in areas other than the tamper-evident structure 715. In this manner, the ledge 225 is generally uniform around the container 100 and does not increase in width at the tamper-evident structure 715, like the structure 115 shown in FIG. 4. Also, the term "PULL DOWN" can be located on a vertical face of the body corner 730 rather than the grip 735. Other modifications similar to those discussed above can be implemented without departing from the spirit and scope of the present application.

Figure 8:
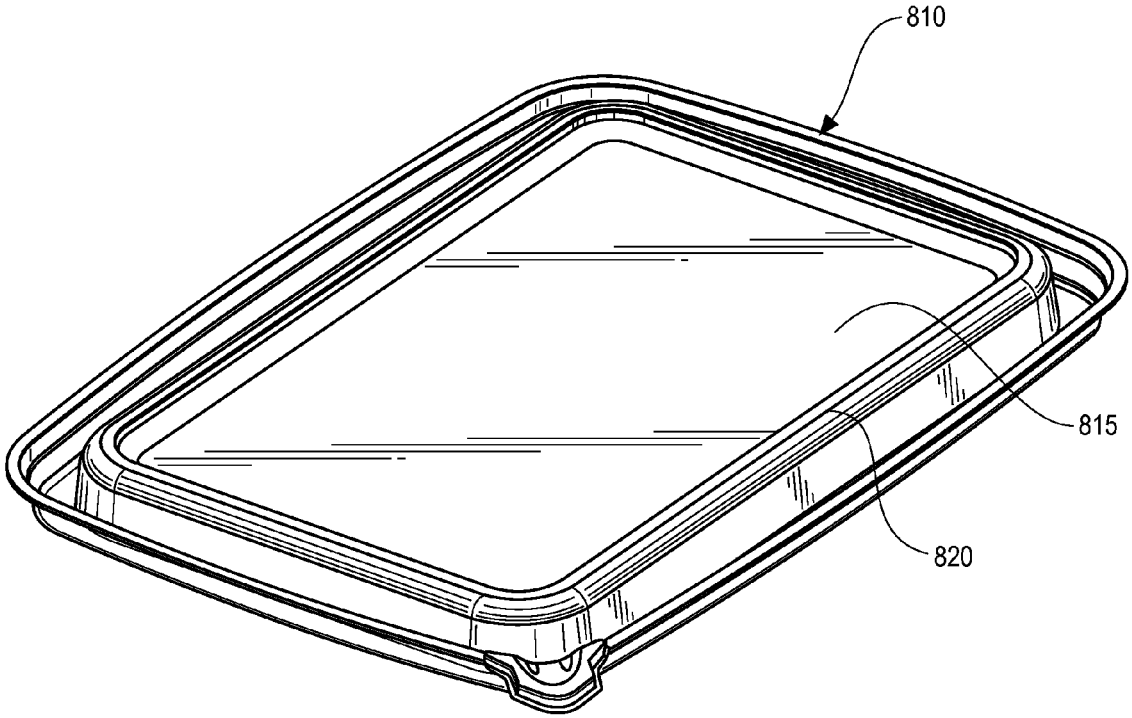
FIG. 8 is a perspective view of a lid according to an embodiment of the present application.

FIG. 8 illustrates a lid 810 according to another embodiment of the present application. In this embodiment, the lid 810 includes structure that allows stacking of one or more containers 100. As shown, the lid 810 includes a stacking surface 815 with a perimeter 820. The stacking surface 815 and perimeter 820 are sized such that a bottom of a container 100 can be placed on the stacking surface 815 and within the interior of the perimeter 820. The perimeter 820 may be raised to inhibit lateral movement of a stacked container 100.

Figure 9:
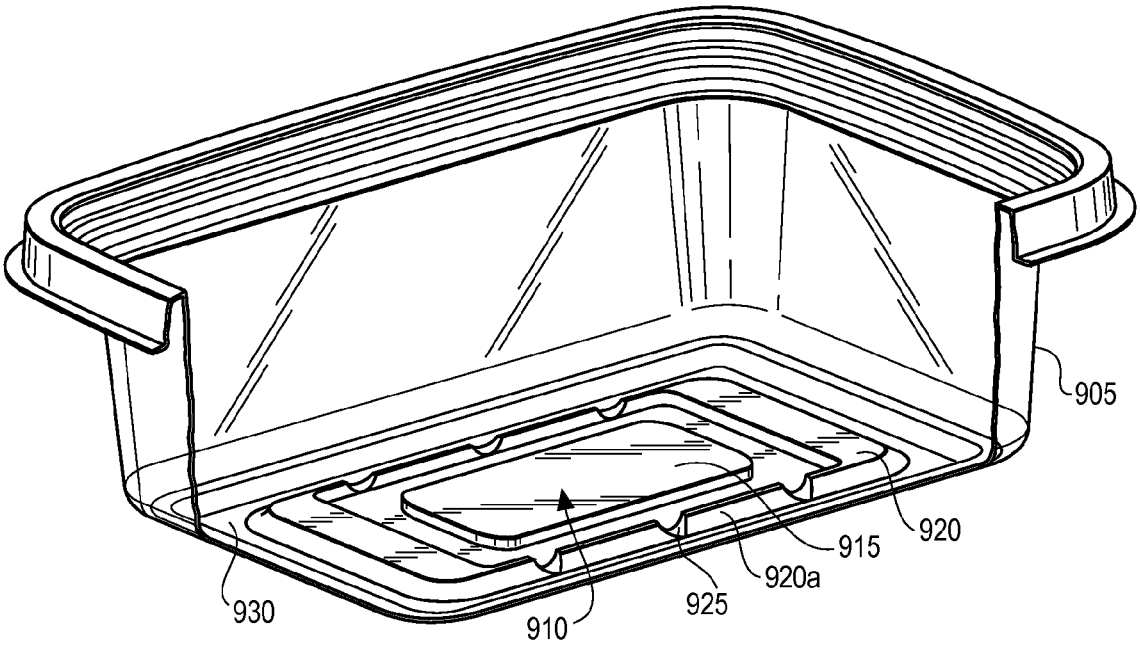
FIG. 9 is a broken perspective view of a body according to an embodiment of the present application.

FIG. 9 illustrates another embodiment of the body 905 with a liquid-retaining reservoir 910 provided on a bottom surface of the body 905. The liquid-retaining reservoir 910 can retain liquids, such as juices or water from produce, in the bottom of the body 905 and keep the contents of the container 100 from being submerged in the liquid. For example, if strawberries are held in the container 100, the liquid-retaining reservoir 910 can prevent the strawberries from soaking in their own juices and better preserve the strawberries.

As shown, the liquid-retaining reservoir 910 includes a platform 915 with a perimeter 920. The perimeter 920 can be continuous or, if discontinuous, can include segments 920A separated by gaps 925. A channel 930 is disposed lower than the raised platform 915 and perimeter 920 to collect any liquids that may be in the container 100.

As shown in the figures, the container 100 is a closed container with no holes or vents provided in any of the components. However, the container 100 can include holes or cavities provided in any of the components, for example, the body 105 or the lid 110, to provide ventilation for the contents of the container 100, without departing from the spirit and scope of the present application. In an embodiment, the container 100 is made of a plastic. However, the container 100 or individual components can be made of any material.

A process for activating the tamper-evident structure 115 and removing the lid 110 from the body 105 will now be discussed. To activate the tamper-evident structure 115, a user can grip with their fingers the perimeter 330 of the lid 110 and pull downwardly on the perimeter 330 to break the perforated edges 250 of the body corner 230, thereby activating the tamper-evident structure 115. Upon breaking the perforated edges 250, the body corner 230 remains coupled to the body 105 by way of the hinge 255. Thus, a user can be aware that the tamper-evident structure 115 has been activated and the container 100 was previously opened.

Once the tamper-evident structure 115 is activated, a user can remove the lid 110, partially or fully, from body 105 by pulling upwardly on, for example, the lid corner 325, which is rigidly coupled to or integrally formed with the remainder of the lid 110 by way of interface 335. The intersection between the raised portion 320 and the trough 310 can provide a gripping portion for the user to grip and move the lid 110 away from or towards the body 105 after the tamper-evident structure 115 is activated and the lid 110 disengaged from the body 105.

As discussed above, the tamper-evident structure 115 is located on a corner of the container 100. However, the tamper-evident structure 115 can be located at any portion of the container 100, for example, around the periphery of a circular container, or along an edge of a polygonal container. Any location of the tamper-evident structure 115 can be implemented without departing from the spirit and scope of the present invention.

The matter set forth in the foregoing description and accompanying drawings and examples, is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A tamper-evident container comprising:

a body;

a ledge extending generally uniformly in an outwardly direction circumferentially around the body;

a body corner extending beyond the ledge in the outwardly direction and having first and second peripheral edges and a body corner perimeter extending therebetween, the body corner being coupled to the body by at least one of a partial perforated edge and a scored edge and adapted to be at least partially decoupled from the body by application of a first force in a first direction, first and second grips extending in the outwardly direction from the ledge;

first and second ramps extending from the body corner across the at least one of the partial perforated edge and scored edge, the first and second ramps adapted to respectively couple the first and second peripheral edges to the ledge; and a lid removably coupled to the body and having a lid corner with a lid corner portion, wherein the lid is adapted to be removable from the body by application of a second force to the lid corner portion in a second direction, wherein the lid corner is adapted to matingly engage with the body corner within the body corner perimeter such that the lid corner portion is inaccessible until the first force is applied.

2. The tamper-evident container of claim 1, wherein the body corner is further coupled to the body by a solid, unperforated edge.

3. The tamper-evident container of claim 1, wherein the lid corner includes a rib adapted to provide stiffness to the lid corner.

4. The tamper-evident container of claim 1, wherein at least one of the first and second ramps is angled relative to a direction in which the partial perforated edge extends.

5. The tamper-evident container of claim 1, wherein after application of the first force, the at least one of the partial perforated edge the at least one of the and scored edge is broken and the body corner remains at least partially coupled to the body.

6. The tamper-evident container of claim 1, wherein the lid includes a trough and the body includes a lip, and wherein the trough is adapted to flex inwardly and pinch against the lip when pushed therein.

7. The tamper-evident container of claim 1, wherein the lid includes a stacking surface adapted to support a second container.

8. The tamper-evident container of claim 1, wherein the body includes a liquid-retaining reservoir having a platform and a reservoir perimeter.

9. The tamper-evident container of claim 8, wherein the reservoir perimeter is discontinuous.

10. The tamper-evident container of claim 8, wherein the platform and reservoir perimeter are separated by a trough.

11. The tamper-evident container as claimed in claim 1, wherein the second direction is opposite the first direction.

* * * * *